US005096187A

United States Patent [19]

Marples

[11] Patent Number: 5,096,187

[45] Date of Patent: Mar. 17, 1992

[54] EXERCISE APPARATUS

[76] Inventor: James H. Marples, 1673 Lowell, Claremont, Calif. 91711

[21] Appl. No.: 663,680

[22] Filed: Mar. 4, 1991

[51] Int. Cl.[5] ..... A63B 21/00

[52] U.S. Cl. ..... 272/93; 272/62; 272/63

[58] Field of Search ..... 108/6, 67, 99, 113, 108/118; 248/136, 150; 135/66, 67, 72, 74; 272/62, 63, 144, 93, DIG. 5

[56] References Cited

U.S. PATENT DOCUMENTS

| | | | |
|---|---|---|---|
| 2,666,640 | 2/1952 | Jennings | 272/93 |
| 3,521,881 | 7/1970 | Schaevitz | 272/93 |
| 3,688,789 | 9/1972 | Bunch | 272/93 |
| 3,807,729 | 4/1974 | Sigma | 272/68 |
| 3,953,025 | 4/1976 | Mazman | 272/132 |
| 4,846,458 | 7/1989 | Potts | 272/65 |
| 4,932,653 | 6/1990 | Schwartz | 272/93 |

OTHER PUBLICATIONS

AVITA Dip Stand M&R Industries 9215 151st Ave. NE., Redmond, Washington, 1984.

*Primary Examiner*—Stephen R. Crow
*Assistant Examiner*—J. Donnelly
*Attorney, Agent, or Firm*—Leon Gilden

[57] ABSTRACT

An exercise apparatus for use in grasping by an individual to perform a "dip" procedure, wherein a plurality of hand grips are grasped and an individual's torso is lowered and subsequently raised in a repetitive manner. The organization includes a counter means operative to provide a total of exercise repetitions effected by an individual.

1 Claim, 2 Drawing Sheets

10
11
12
13
14
15
16
17
18
19
20
21
22
23
24
25
26
27
28
29

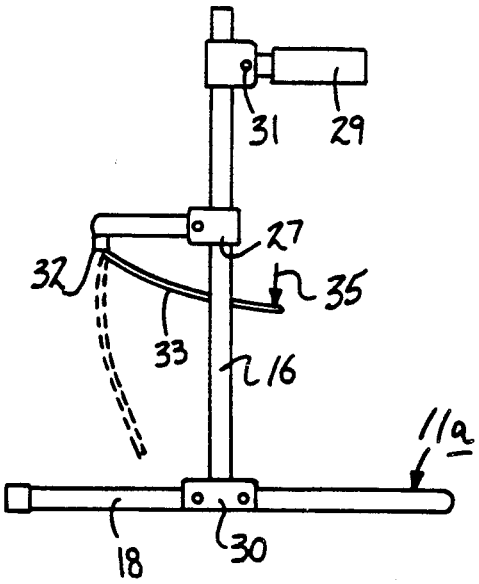
FIG 2
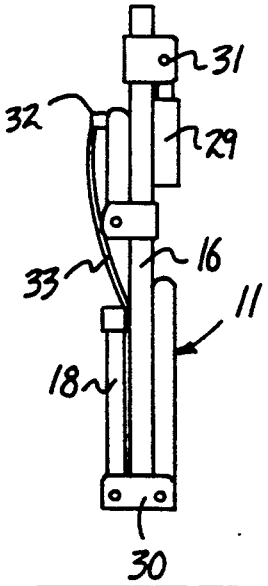
FIG 3
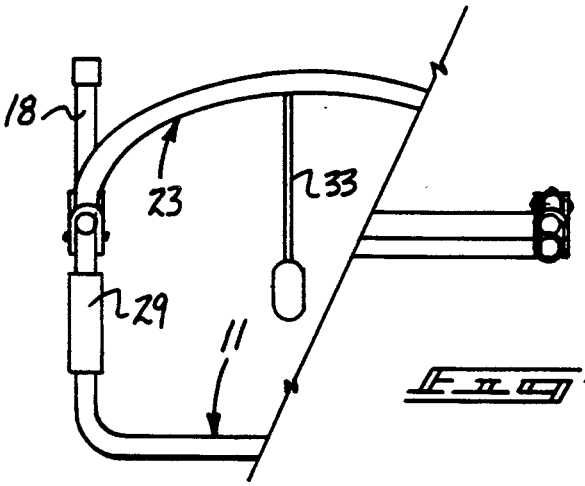
FIG 4
FIG 5
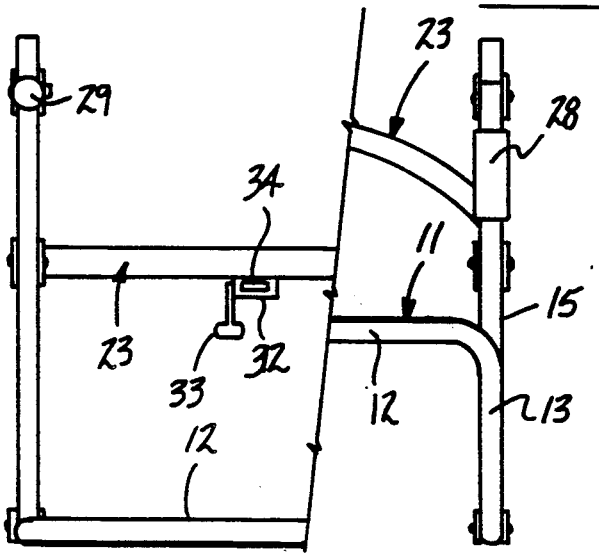

EXERCISE APPARATUS

BACKGROUND OF THE INVENTION

1. Field of the Invention

The field of invention relates to exercise apparatus, and more particularly pertains to a new and improved exercise apparatus wherein the same is arranged for performing repetitive exercise.

2. Description of the Prior Art

Various exercise apparatus has been utilized in the prior art for specialized applications to provide exercise of discrete portions of an individual's anatomy. Such apparatus may be found in U.S. Pat. No. 4,834,364 to Gongwer wherein a unitary exercise pull with cross members is arranged for grasping by an individual to pivotally oscillate the bar relative to a support base in a repetitive manner.

U.S. Pat. No. 3,572,701 to Agamians sets forth an exercise apparatus wherein central hand grips are mounted and are positioned medially of a slide rod to permit sliding of an individual's legs relative to the slide rod.

U.S. Pat. No. 3,966,200 to Kirk sets forth a stretching exercise apparatus wherein in opposed parallel rails are grasped by an individual's hands and an individual's feet positioned in a spaced relationship to effect a stretching procedure.

As such, it may be appreciated that there continues to be a need for a new and improved exercise apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of exercise apparatus now present in the prior art, the present invention provides an exercise apparatus wherein the same utilizes collapsible bar structure arranged for ease of transport and storage during periods of non-use and may be further extended for a structure to permit repetitive exercise for an individual. As such, the general purpose of the present invention, which will be described subsequently in greater detail, is to provide a new and improved exercise apparatus which has all the advantages of the prior art exercise apparatus and none of the disadvantages.

To attain this, the present invention provides an exercise apparatus for use in grasping by an individual to perform a "dip" procedure, wherein a plurality of hand grips are grasped and an individual's torso is lowered and subsequently raised in a repetitive manner. The organization includes a counter means operative to provide a total of exercise repetitions effected by an individual.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved exercise apparatus which has all the advantages of the prior art exercise apparatus and none of the disadvantages.

It is another object of the present invention to provide a new and improved exercise apparatus which may be easily and efficiently manufactured and marketed.

It is a further object of the present invention to provide a new and improved exercise apparatus which is of a durable and reliable construction.

An even further object of the present invention is to provide a new and improved exercise apparatus which is susceptible of a low cost of manufacture with regard to both materials and labor, and which accordingly is then susceptible of low prices of sale to the consuming public, thereby making such exercise apparatus economically available to the buying public.

Still yet another object of the present invention is to provide a new and improved exercise apparatus which provides in the apparatuses and methods of the prior art some of the advantages thereof, while simultaneously overcoming some of the disadvantages normally associated therewith.

Still another object of the present invention is to provide a new and improved exercise apparatus wherein the same utilizes collapsible bar structure arranged for ease of transport and storage during periods of non-use, and may be further extended for a structure to permit repetitive exercise for an individual.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is an orthographic side view, taken in elevation, of the instant invention utilizing a modified support base and counter mechanism.

FIG. 3 is an orthographic side view of the instant invention, as set forth in FIG. 2, in a folded configuration.

FIG. 4 is an orthographic top view of the invention illustrating the invention in an opened and folded configuration.

FIG. 5 is an orthographic front view, taken in elevation, of the instant invention with the organization in an opened and folded configuration.

DESCRIPTION OF THE PREFERRED EMBODIMENT

Figure 1:
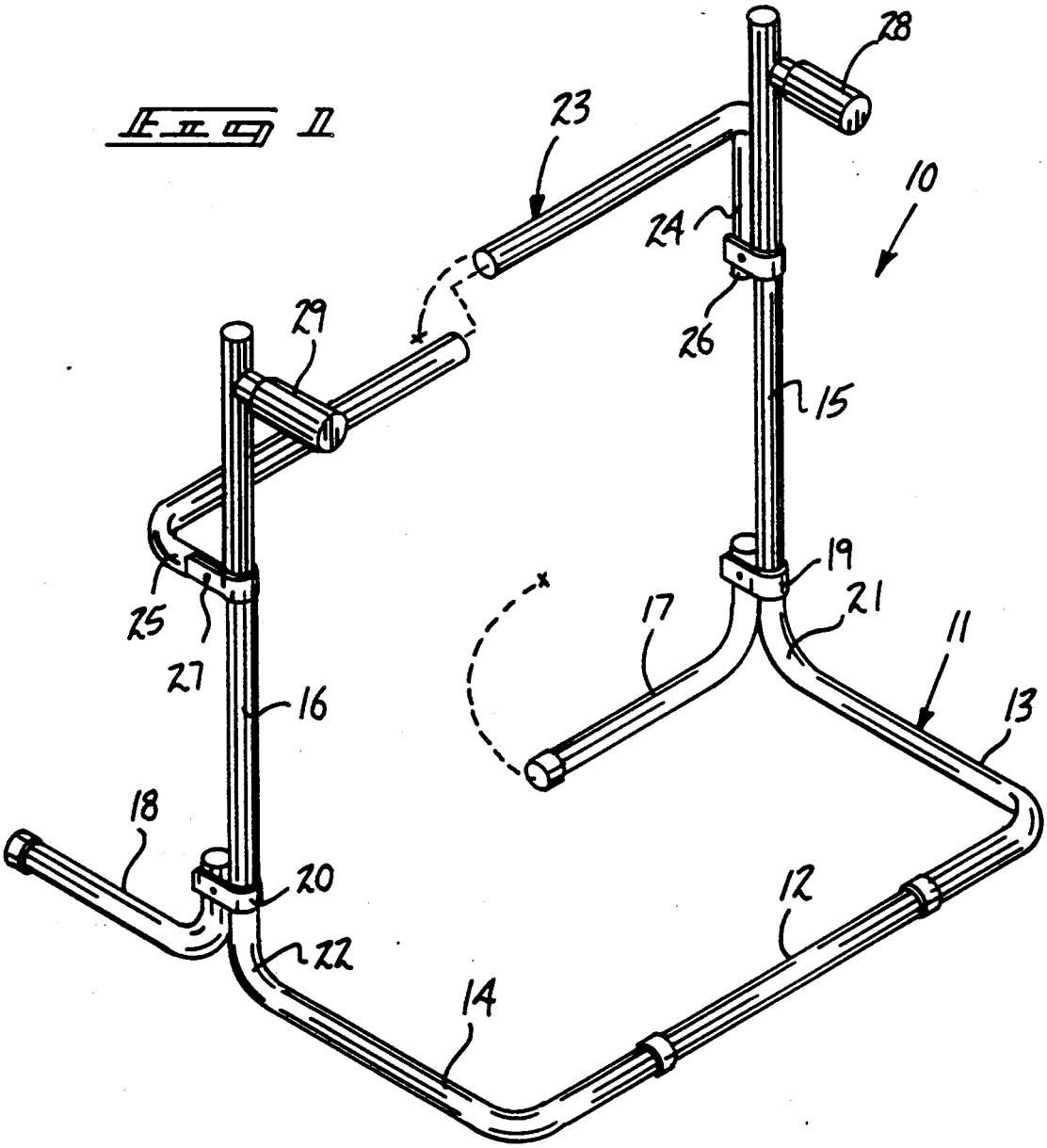
FIG. 1 is an isometric illustration of the instant invention.

With reference now to the drawings, and in particular to FIGS. 1 to 5 thereof, a new and improved exercise apparatus embodying the principles and concepts of the present invention and generally designated by the reference numeral 10 will be described.

More specifically, the exercise apparatus 10 of the instant invention essentially comprises a "U" shaped support frame 11 defined by a base leg 12, with respective right and left brace legs 13 and 14 fixedly and orthogonally mounted to the base leg 12 defining the right and left brace legs 13 and 14 in a parallel coextensive relationship relative to one another. A respective right and left support leg 15 and 16 are orthogonally mounted to the right and left support legs at each end thereof remote from the base leg 12 to arrange the right and left support legs 15 and 16 in a parallel coextensive relationship. The right and left support legs 15 and 16 are joined to the right and left brace legs 13 and 14 at a respective left and right base leg junction 21 and 22. A right and left stabilizer leg 17 and 18 are each respectively mounted adjacent the respective right and left junction 21 and 22 by respective right and left mounting collars 19 and 20 permitting pivotment of the right and left stabilizer legs 17 and 18 from a first position aligned with the respective right and left brace legs 13 and 14 to a second position orthogonally oriented relative to the right and left brace legs 13 and 14. The right and left stabilizer legs 17 and 18 are each of a length substantially one-half that of the base leg 12 to permit alignment of the stabilizer legs 17 and 18 when in a second position.

A "U" shaped support brace 23 is mounted medially of the right and left support legs 15 and 16 by locking and left pivot supports 26 and 27 to permit locking of the "U" shaped support base 23 in a first position vertically disposed relative to the right and left support legs 15 and 16 to a second folded position, wherein the "U" shaped support brace 23, including support brace right and left legs 24 and 25, are disposed parallel to the respective right and left support legs 15 and 16, as illustrated in FIG. 1 for example.

Right and left hand grip bars 28 and 29 are orthogonally mounted adjacent upper terminal ends of the right and left support legs 15 and 16 in an overlying spaced parallel relationship relative to the right and left brace legs 13 and 14 to permit manual grasping of the right and left hand grip bars 28 and 29. In this manner, an individual utilizes a left hand to grasp the right hand grip bar 28 and a right hand to grasp the left hand grip bar 29, where a person may then reciprocate an individual's torso in a vertical relationship relative to the support frame 11. To assist in this procedure, a counter member 32 is fixedly mounted medially of the "U" shaped support base 23 (see FIGS. 2-5), wherein the counter mechanism 32 is of a ratchet type counter mechanism operative through an actuator lever 33, wherein the actuator lever 33 extends forwardly from a bottom surface of the "U" shaped support base 23 between the right and left support legs 15 and 16 to a position between the "U" shaped support frame 11, whereupon an individual's torso is effected into abutment with the actuator lever 33 upon reciprocation of the torso into contact with a free terminal end of the actuator lever 33, in a manner as depicted by the torso displacement arrow 35 in FIG. 2.

If desired, locking pins 31 may be provided to lockingly mount the right and left grip bars 28 and 29 from a horizontal orientation, as illustrated in FIG. 2, to a vertical displacement, as illustrated in FIG. 3, to permit folding of the organization for ease of transport and storage thereof. Further, a base mounted 30 (see FIGS. 2 and 3) are utilized to permit pivotment of the right and left base legs 13 and 14, as well as the right and left stabilizer legs 17 and 18 into a parallel relationship relative to the right and left support legs 15 and 16.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An exercise apparatus comprising, a "U" shaped support frame, the "U" shaped support frame including a base leg fixedly and orthogonally mounting a right brace leg and a left brace leg at opposed terminal ends of the base leg, wherein the right and left brace legs are arranged parallel and coextensive relative to one another, and the right brace leg orthogonally and fixedly mounts a right support leg at a forward terminal end spaced from the base leg, and the left brace leg mounts a left support leg fixedly and orthogonally relative to a left terminal end spaced from the base leg, wherein the right and left support legs are arranged parallel and coextensive relative to one another, and the right support leg mounted to the right brace leg at a right junction, and the left support leg mounted to the left brace leg at a left junction, and a right stabilizer leg pivotally mounted to the right support leg adjacent the junction, and a left stabilizer leg pivotally mounted to the left support leg adjacent a left junction, and the right and left stabilizer legs are pivotal from a first position aligned respectively with a right and left brace leg to a second position arranged parallel to the base leg, and a right hand grip bar fixedly and orthogonally mounted to the right support leg adjacent the right support leg upper terminal end, and a left hand grip bar fixedly and orthogonally mounted to the left brace leg adjacent the left brace leg's upper terminal end, and wherein the right and left hand grip bars are arranged parallel relative to one another, wherein the right hand grip bar is arranged in overlying relationship relative to the right brace leg, and the left hand grip bar is arranged in an overlying relationship relative to the left brace leg, wherein the right and left hand grip bars are spaced an equal predetermined spacing from the respective right and left brace legs, and including a "U" shaped support brace, the "U" shaped support base includes a support brace left leg and a support brace right leg, the support brace left leg and support brace right leg are arranged parallel relative to one another, and wherein the support brace left leg includes a support brace right pivot support, and the support base left leg includes a support brace left pivot support, wherein the respective support brace right pivot support and the support brace left pivot support are each respectively mounted to the respective right and left support legs medially thereof between the right hand grip bar and right brace leg and the left hand grip bar and the left brace leg respectively, and wherein the support brace right pivot support and the support brace left pivot support include a locking means to effect locking of the "U" shaped support brace from a brace first position arranged orthogonally relative to the right and left support legs to a second brace position, wherein the "U" shaped support brace is arranged orthogonally relative to the "U" shaped support frame, and including a counter member fixedly and orthogonally mounted medially of the "U" shaped support brace to a bottom surface thereof, the counter member includes an actuator lever, wherein the actuator lever is orthogonally oriented relative to the "U" shaped support base and extends medially between the right support leg and the left support leg and extends forwardly of the "U" shaped support brace and the right and left support legs to position medially of the "U" shaped support frame.

* * * * *